US007273002B1

(12) United States Patent
Rogers

(10) Patent No.: US 7,273,002 B1
(45) Date of Patent: Sep. 25, 2007

(54) METHOD AND DEVICE FOR INCREASING THE RATE OF THE FIRING CYCLE OF A SEMI-AUTOMATIC FIREARM

(75) Inventor: Steve Rogers, Pittsboro, IN (US)

(73) Assignee: AW-SIM, LLC, Brownsburg, IN (US)

( * ) Notice: Subject to any disclaimer, the term of this patent is extended or adjusted under 35 U.S.C. 154(b) by 0 days.

(21) Appl. No.: 11/060,911

(22) Filed: Feb. 18, 2005

(51) Int. Cl.
*F41A 19/09* (2006.01)
*F41A 3/88* (2006.01)
*F41A 25/00* (2006.01)

(52) U.S. Cl. ..... 89/142; 89/177; 89/178; 89/37.13; 89/42.01

(58) Field of Classification Search ..... 89/140–142, 89/129.01–131, 161, 162, 177, 178, 9, 37.01, 89/37.13, 40.06, 42.01, 42.02, 44.01, 44.02; 42/1.06

See application file for complete search history.

(56) References Cited

U.S. PATENT DOCUMENTS 1,307,594 A * 6/1919 Newman ..... 89/1.1
2,139,691 A * 12/1938 Michall, Jr. ..... 89/140
3,641,694 A * 2/1972 Seidel et al. ..... 42/72
4,685,379 A 8/1987 Troncoso
4,787,288 A 11/1988 Miller
4,803,910 A 2/1989 Troncoso
4,932,309 A 6/1990 Barrett
5,074,190 A 12/1991 Troncoso
5,780,762 A * 7/1998 Kobayashi ..... 89/140
5,852,891 A 12/1998 Onishi et al.
6,101,918 A 8/2000 Akins
6,164,002 A 12/2000 Troncoso
6,223,644 B1 5/2001 Troncoso
6,302,092 B1 10/2001 Juan
6,581,814 B1 6/2003 Hsu

* cited by examiner

*Primary Examiner*—Bret Hayes
(74) *Attorney, Agent, or Firm*—Michael A. Myers

(57) ABSTRACT

A device and method for increasing the rate of the firing cycle of a semi-automatic firearm includes a base that is adapted to support any one of a variety of semi-automatic firearms. The base includes a trigger extension with a grip, a slide mount, and a slide housed within the slide mount. At least the receiver, barrel, and trigger assembly of the firearm are secured to the base so that they may move as a single unit upon the base between a rearward position upon discharge of the firearm and a forward position. A biasing means continuously biases the receiver, barrel, and trigger assembly upon the base toward the forward position to effect successive discharges of the firearm.

15 Claims, 9 Drawing Sheets

METHOD AND DEVICE FOR INCREASING THE RATE OF THE FIRING CYCLE OF A SEMI-AUTOMATIC FIREARM

TECHNICAL FIELD OF THE INVENTION

This invention relates generally to firearms and, more particularly, to a method and device for increasing the rate of the firing cycle of a semi-automatic firearm.

BACKGROUND OF THE INVENTION

Among the differences between automatic firearms and semi-automatic firearms is the rate of their respective firing cycles. Generally, the firing cycle of a semi-automatic firearm involves the sequential steps of depressing the trigger, releasing the trigger, and re-depressing the trigger. Upon discharge, a semi-automatic firearm typically ejects a spent cartridge casing and sequentially feeds a loaded cartridge into the chamber. The "auto-loading" feature of the semi-automatic does not change the fact that a semi-automatic firearm will not discharge without the sequential release and re-depression of the trigger. Hence, the rate of the firing cycle of these firearms is limited by the speed at which the shooter can repeatedly depress, release, and re-depress the trigger.

The firing rate of an automatic firearm, on the other hand, is not. Instead, an automatic firearm will continue to rapidly fire all available rounds in the magazine so long as the trigger remains depressed. When the rate of the firing cycle of the automatic is compared to the firing rate of the semi-automatic, one understands that the firing rate of the semi-automatic firearm is typically limited by the shooter's reaction time; and, even the most proficient shooter cannot discharge more than about one or two rounds per second.

It is important to understand that the National Firearms Act prohibits possession of automatic firearms within the United States, or the District of Columbia, without special authorization. As a result, some innovators have tried to enhance the cyclic firing rate of a semi-automatic firearm to approach the firing rate of the automatic.

Such devices and methods, however, are replete with shortcomings. One such method, like the apparatus shown in U.S. Pat. No. 6,101,918, requires substantial irrevocable modifications to the firearm. The stock is cut out, and a stop member is permanently secured to the stock near the trigger assembly, for example. U.S. Pat. No. 5,074,190 describes another device that has a spring-biased paddle that engages the rear of the trigger and continually urges it forwardly. This device, and others that follow along these lines (U.S. Pat. Nos. 6,164,002, 6,223,644, 5,852,891, 4,803,910, and 4,685,379), require the firearm to be handled in a manner different from a long-arm style. This, and the extreme dexterity typically required to operate these "trigger assemblies" interfere with the accuracy of the shot.

Thus, there remains a need for a device and method that accelerates the rate of the firing cycle of a semi-automatic firearm that does not interfere with the shooter's handling of the firearm and cause him to miss his target. Additionally, there remains a need for such a device and method that does not require extreme dexterity to operate, and that can be used with most any semi-automatic firearm without substantially and irrevocably modifying the firearm. The present invention addresses these needs.

SUMMARY OF THE INVENTION

The present invention relates to a device for increasing the rate of the firing cycle of a semi-automatic firearm that has at least a receiver, a barrel, and a trigger assembly. The device includes a base for supporting the firearm, a trigger extension with a grip attached to the base, and means for removably securing at least the receiver, the barrel, and the trigger assembly to the base. Once secured to the base, the receiver, the barrel, and the trigger assembly are permitted to move as a single unit relative to the base between a rearward position upon discharge of the firearm and a forward position. At least the receiver, barrel, and trigger assembly are continuously biased toward the forward position.

In another aspect, a semi-automatic firearm and device for increasing the rate of the firing cycle of a semi-automatic firearm are presented in combination. The combination includes a receiver, a barrel, a trigger assembly, and a base for supporting the receiver, barrel and trigger assembly. The base also includes a trigger extension with a grip, and means to removably secure the receiver, the barrel and the trigger assembly to the base. In such a combination, the receiver, the barrel and the trigger assembly can move as a single unit relative to the base between a rearward position upon discharge of the firearm and a forward position. The receiver, the barrel and the trigger assembly are continuously biased toward the forward position.

In yet another aspect of the invention, a method for increasing the rate of the firing cycle of a semi-automatic firearm having at least a receiver, a barrel, and a trigger assembly includes the steps of securing at least the receiver, barrel, and trigger assembly of the firearm to a base. Once done, the receiver, the barrel, and the trigger assembly are permitted to move as a single unit relative to the base between a rearward position upon discharge of the firearm and a forward position. Another step includes depressing the trigger with a trigger extension to discharge the firearm. Another step includes immobilizing the trigger extension in the position it has assumed to discharge the firearm. After the firearm discharges, yet another step is to permit the receiver, the barrel, and the trigger assembly to move to the rearward position to effect complete disengagement between the trigger extension and the trigger. Still another step includes sequentially biasing the receiver, the barrel, and the trigger assembly into engagement with the immobilized trigger extension to effect successive discharges of the firearm.

One object of the present invention is to provide an improved device for increasing the rate of the firing cycle of a semi-automatic firearm. Related objects and advantages of the present invention will be apparent from the following description.

DESCRIPTION OF THE PREFERRED EMBODIMENT

Figure 1:
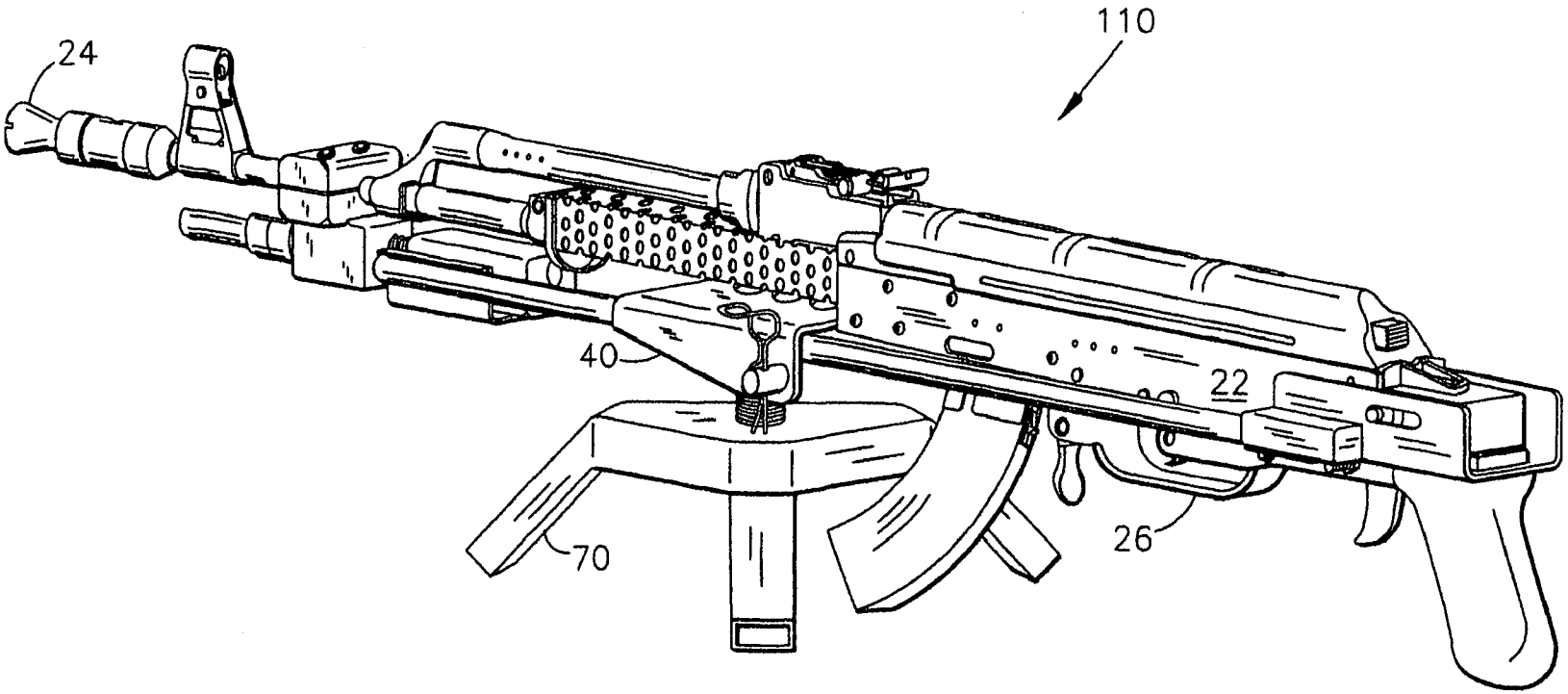
FIG. 1 is a perspective view of a receiver, a barrel, and a trigger assembly of an AK-47 mounted on an embodiment of the base of the present invention.
Figure 2:
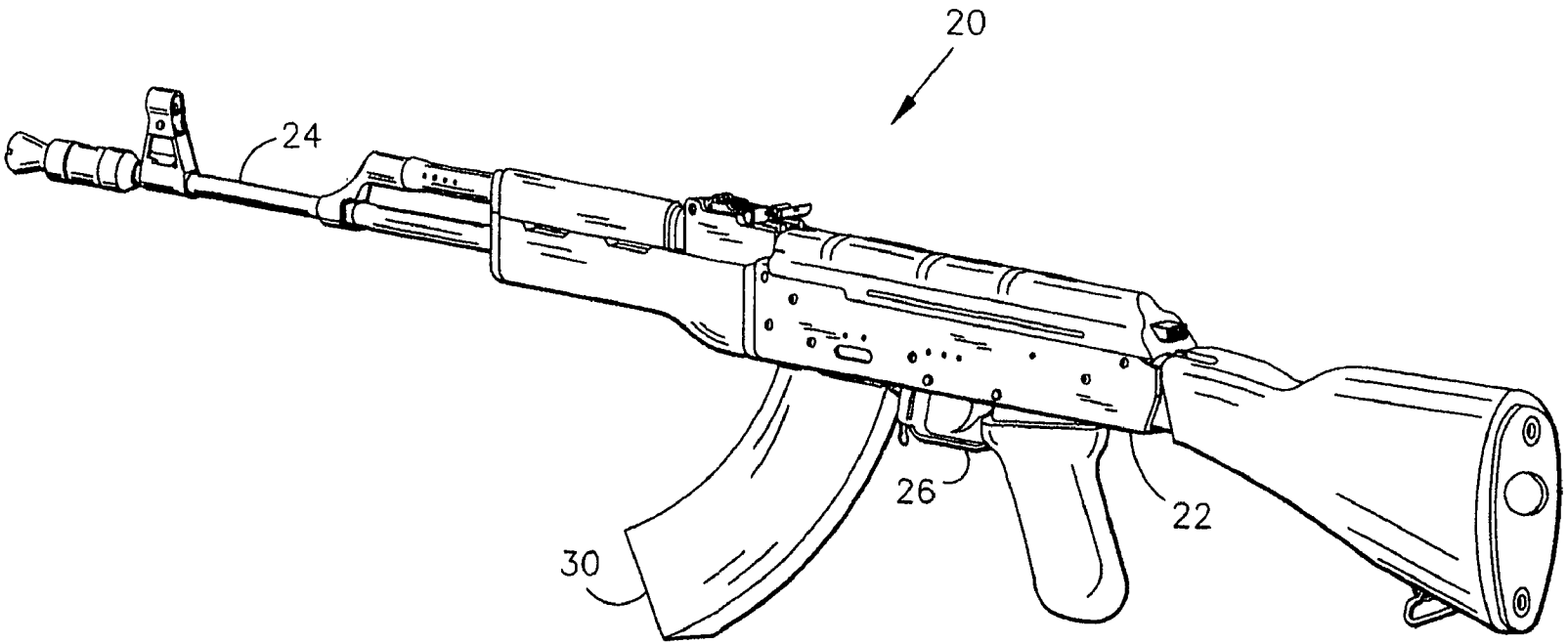
FIG. 2 is a perspective view of an AK-47 semi-automatic weapon, including its barrel, magazine, trigger assembly and receiver.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 3:
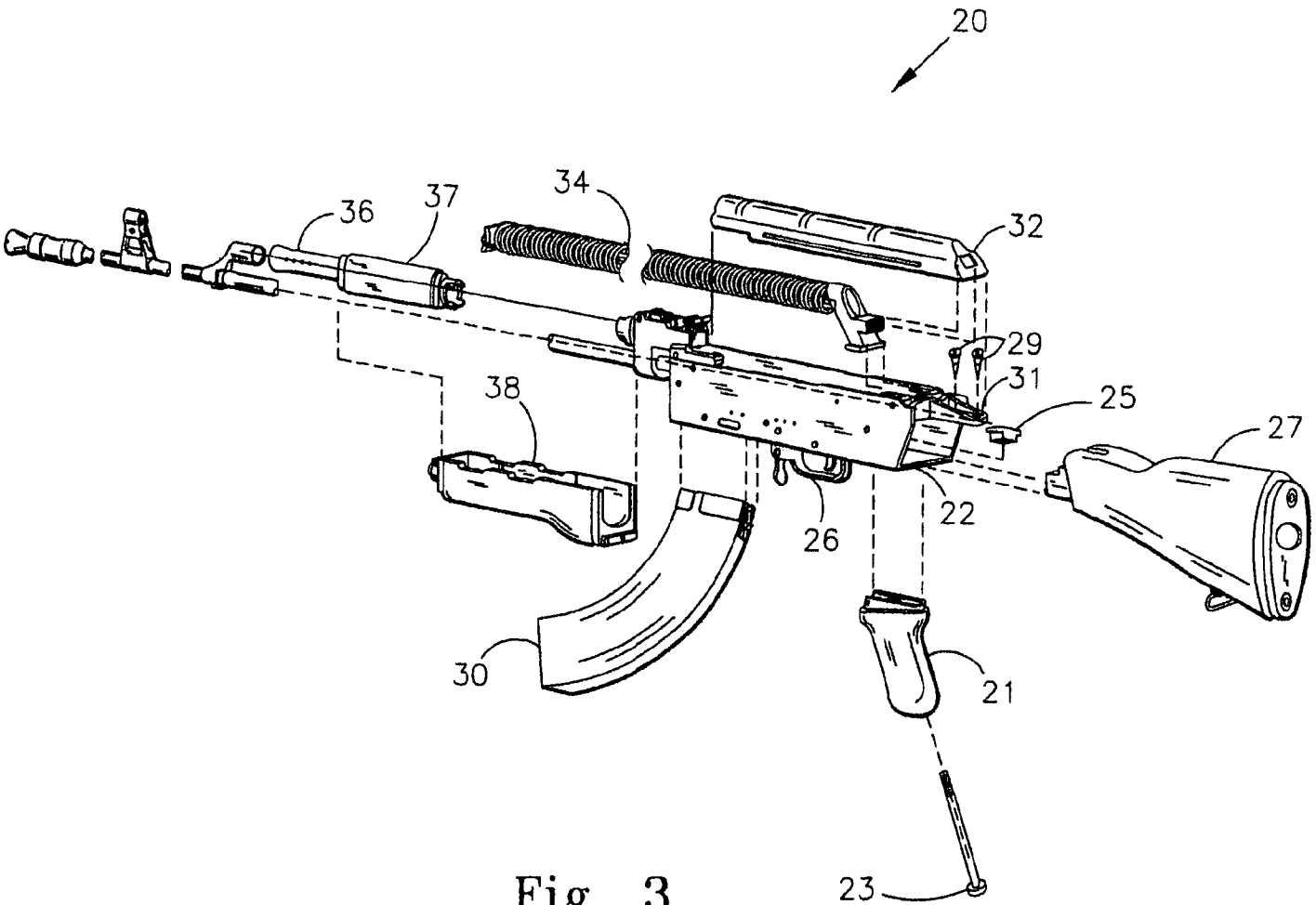
FIG. 3 is an exploded perspective view of the AK-47 semi-automatic weapon of FIG. 2.
Figure 4:
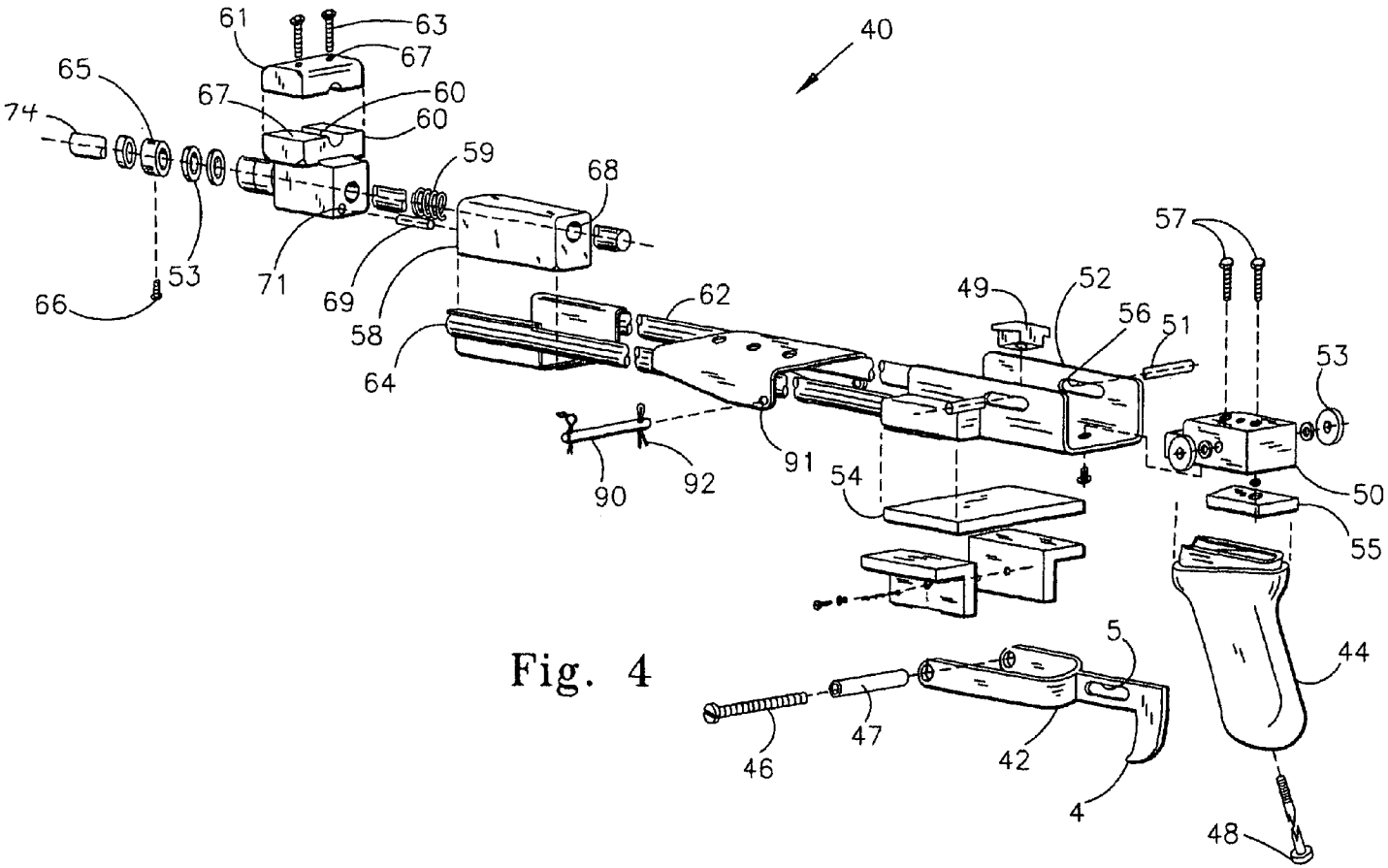
FIG. 4 is an exploded perspective view of an embodiment of the base of the present invention.

FIGS. 1-9 relate to a first embodiment of the present invention, a method and device for increasing the rate of the firing cycle of a semi-automatic firearm of the long-arm type configuration. The device includes a base 40 for supporting at least the receiver 22, barrel 24, and trigger assembly 26 of a firearm 20. Base 40 is formed from a rigid material such as steel or the like and includes trigger extension 42 and grip 44, as shown in FIG. 4. It should be understood that base 40 and its parts may be formed from materials other than steel. Such materials must be rigid and possess the physical and mechanical properties that make them machinable and suitable for supporting the firearms contemplated by the invention. Base 40 must withstand the forces displaced during discharge of the firearm and during assembly and disassembly, as discussed below.

FIGS. 10-13 relate to a second embodiment of the present invention, which relates to a method and device for increasing the rate of the firing cycle of a semi-automatic firearm of the A4 type. Throughout this description, like numerals will be used to identify like parts and features that are common to both of the above-mentioned embodiments.

Figure 10:
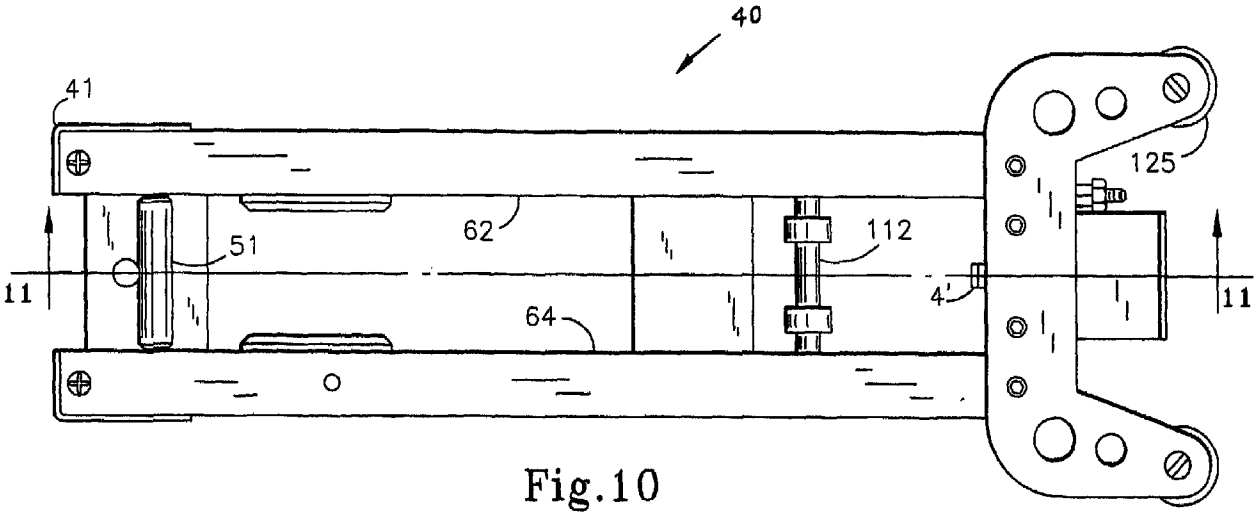
FIG. 10 is an isolated top plan view of an alternate embodiment of the base of the present invention.
Figure 11:
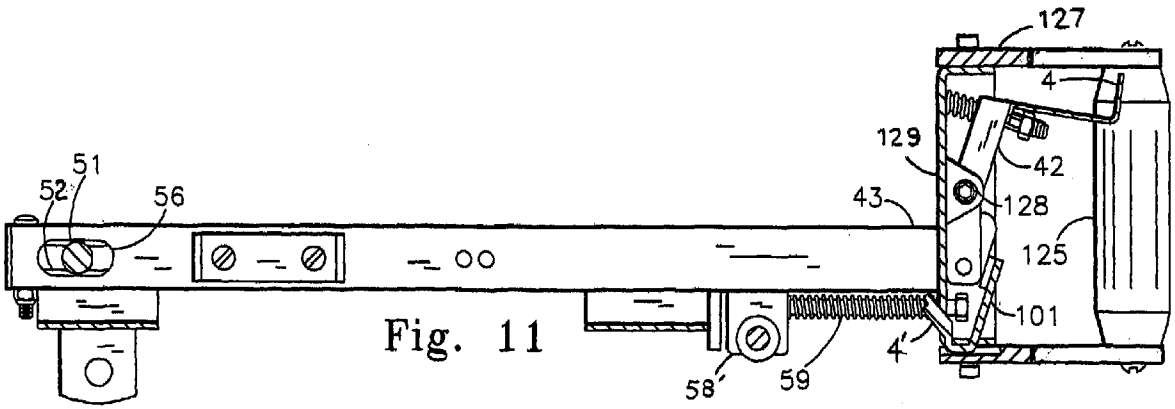
FIG. 11 is a cross-sectional view of the base of FIG. 10 taken along line 11-11.
Figure 12:
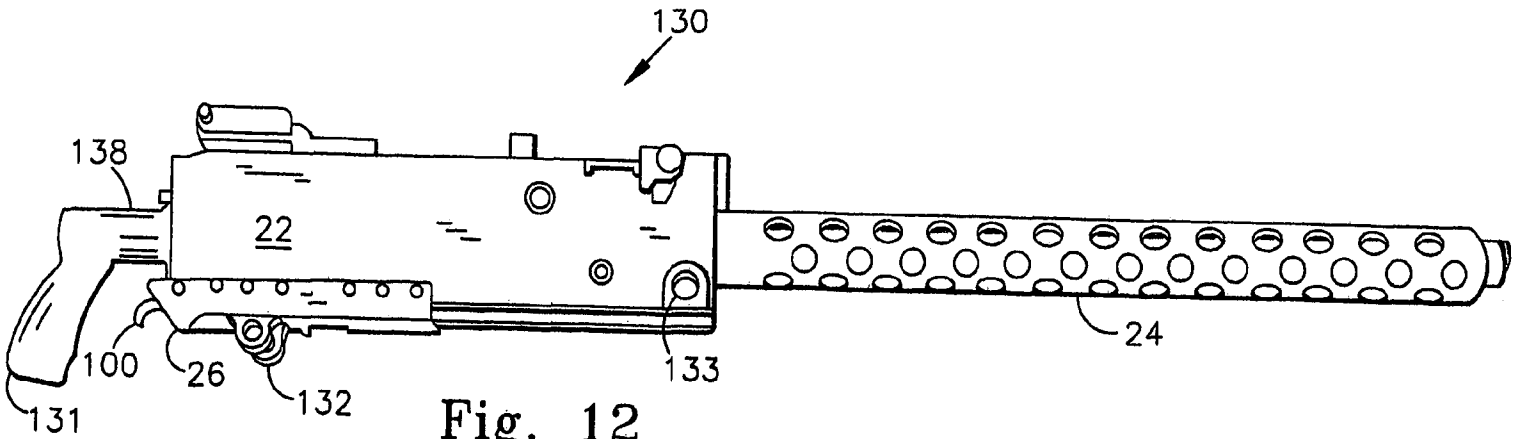
FIG. 12 is a perspective view of an A4 type semi-automatic weapon, including its barrel, receiver, trigger assembly, and buffer.
Figure 13:
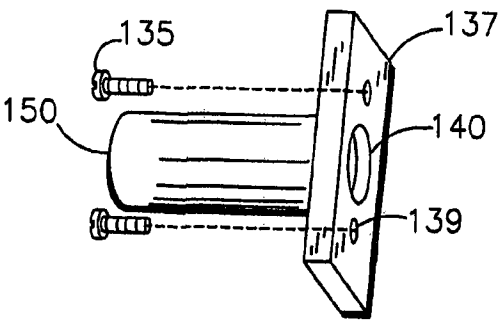
FIG. 13 is a perspective view of the buffer that replaces the buffer and grip on the A4 type weapon of FIG. 12.

With reference to FIG. 4, in a currently preferred embodiment, trigger extension 42 has trigger 4, and grip 44 is a pistol-type grip. The embodiment of base 40 shown in FIGS. 10 and 11 includes trigger extension 42 having trigger 4 and pivot 128. Trigger 4' has upstanding portion 101. Trigger extension 42 is preferably formed from steel, while grip(s) 44, 125, as shown in FIGS. 4, 10-11, may be formed from wood, plastic or other rigid material.

Referring to all the FIGS., front end 41 and rear end 43 of base 40 are connected by elongated steel members 62,64. Base 40 includes slide 50, which is housed in slide mount 52. Slide 50 is presently formed from a material having a low coefficient of friction, such as that sold under the trademark TEFLON. In an embodiment, the front end 41 of base 40 includes a set collar 65, block 58, and a barrel clamp 60 connected by a cylinder 74, as shown in FIG. 4. Barrel clamp 60 has a removable top portion 61 and is fastened to base 40 between collar 65 and block 58. A compression spring 59 is interposed on cylinder 74 between barrel clamp 60 and block 58. Barrel clamp 60 and collar 65 are held in place on cylinder 74 by collar screw 66. A guide rod 69 also joins block 58 and barrel clamp 60 preventing barrel clamp 60 from rotating on cylinder 74.

Figure 5:
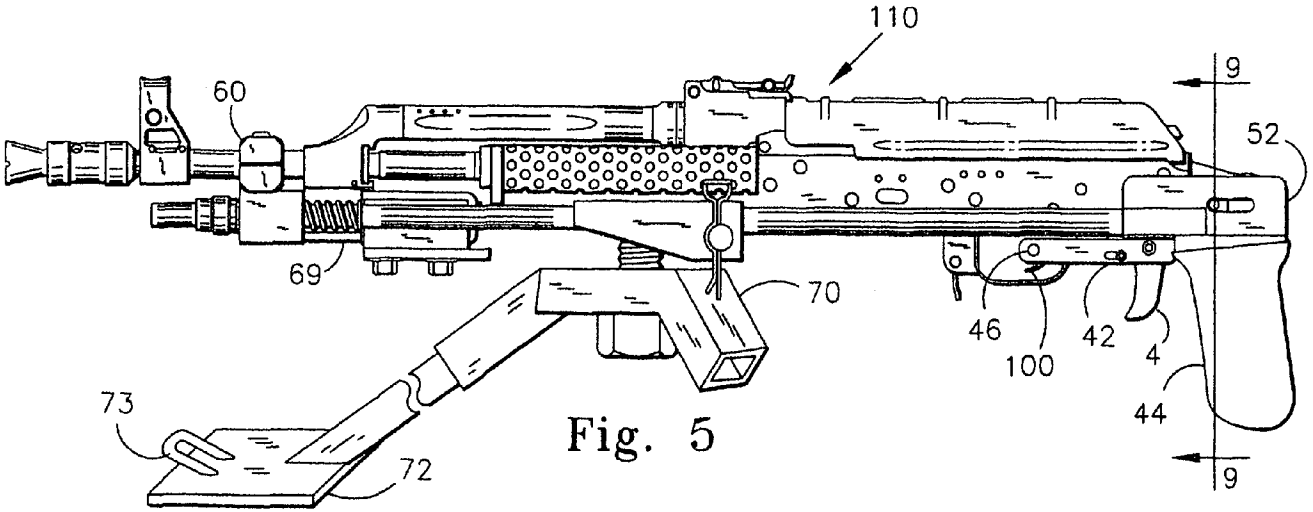
FIG. 5 is a side plan view of an AK-47 in combination with the embodiment of the base of FIG. 4, including an illustration of a leg secured to the base.
Figure 6:
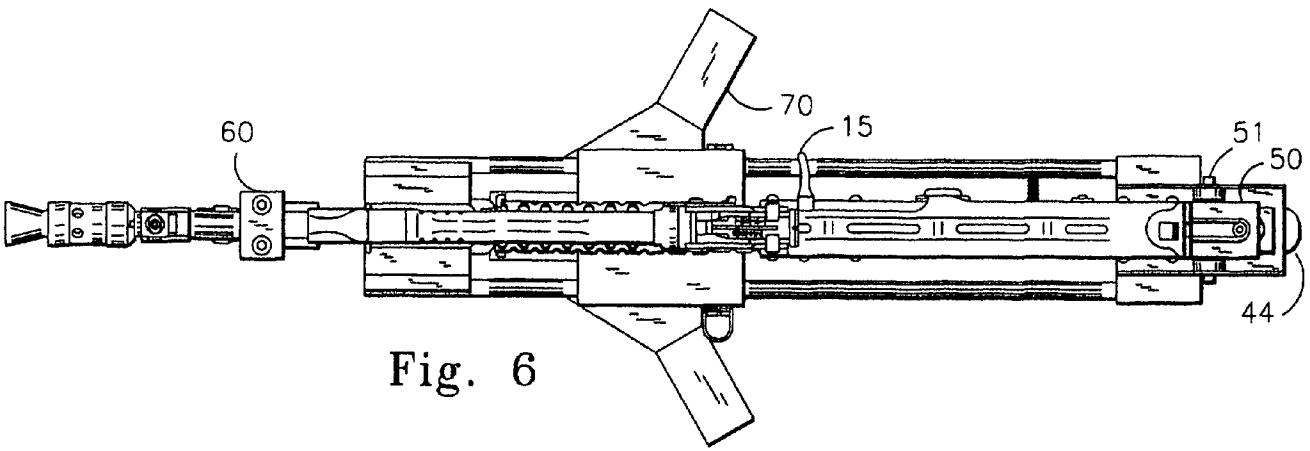
FIG. 6 is a top plan view of the combination of FIG. 5 excluding the leg.

With reference to FIG. 5, in a currently preferred embodiment, base 40 includes legs 70, which telescopically engage base 40. The leg 70 oriented toward front end 41 has ring 73.

With reference to FIGS. 1-9, assembly of one combination firearm and device 110 will be described. Long arm type semi-automatic firearms contemplated by the invention include, for example, the AK-47, AK-74, SKS, Mini 14, M-14, Semi Auto RPD, FAL, M-1 Carbine, Cetme G-3, Daewoo 200, the Smith & Wesson 76 Carbine, and the Ruger AP-9. The AK-47 is used in this disclosure as an example only.

Disassembly of the AK-47 20 is essentially the same as when cleaning the weapon. With reference to FIG. 3, the magazine 30, top cover 32, recoil return spring 34, and the bolt 15 and bolt carrier (not shown) are removed by hand. Next, the upper forearm 37, gas tube 36, and lower forearm 38 are removed. Bolt 23 frees pistol grip 21 from receiver 22. Care should be taken to isolate and contain pistol grip nut 25, which seats in an opening in receiver 22. Butt stock screws 29 are removed, and butt stock 27 is disengaged from tang 31 and receiver 22.

The barrel 24, receiver 22, and trigger assembly 26 are then ready for securing onto base 40. Referring to FIGS. 3 and 4, bolt 46 is removed so that receiver 22 can be positioned on base 40 with trigger assembly 26 inside the U-shaped portion of trigger extension 42. Tang 31 is secured to slide 50 with slide screws 57 and barrel 24 is clamped firmly into clamp 60. Clamp 60 should remain untightened, however, until the receiver 22 is positioned so that trigger 100 of trigger assembly 26 is contacting bolt 46. Screws 63 in top portion 61 are then firmly tightened to hold barrel 24 tightly in place.

Figure 7:
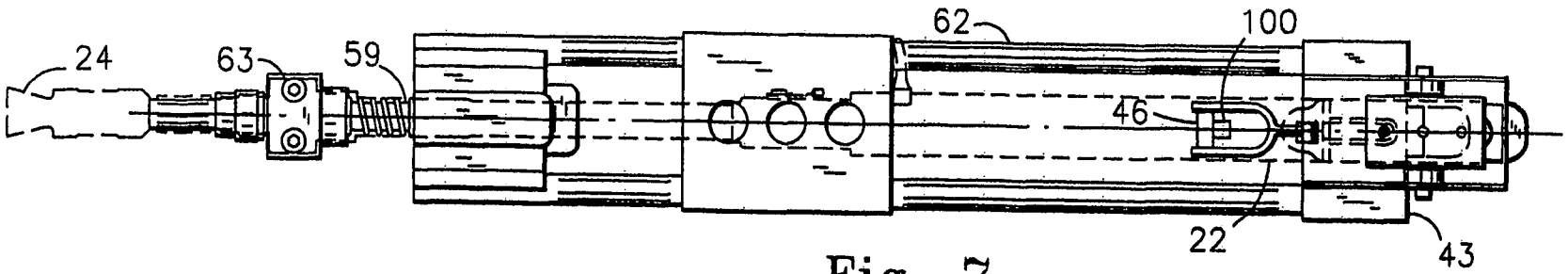
FIG. 7 is a top plan view like the one of FIG. 6 showing the outline of the AK-47 in phantom to illustrate the base in the forward position.
Figure 8:
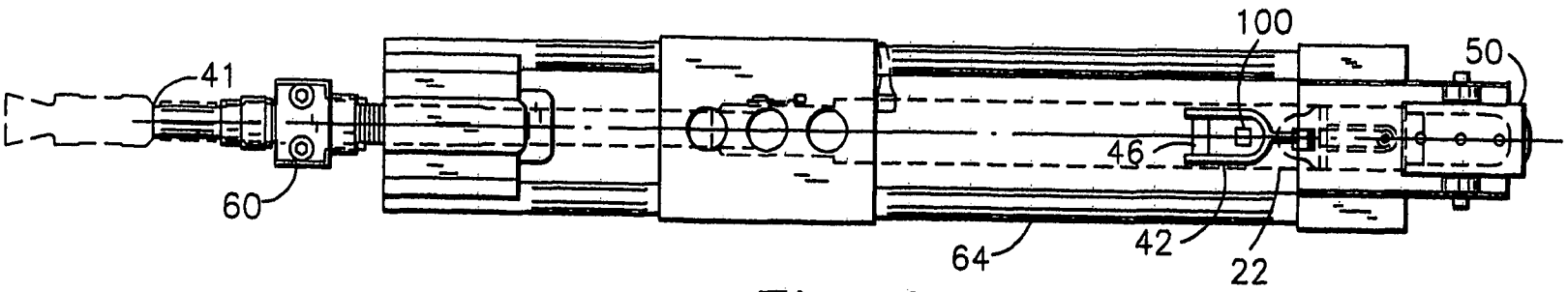
FIG. 8 is a top plan view like FIG. 7 showing the outline of the firearm in phantom and the base in the rearward position.
Figure 9:
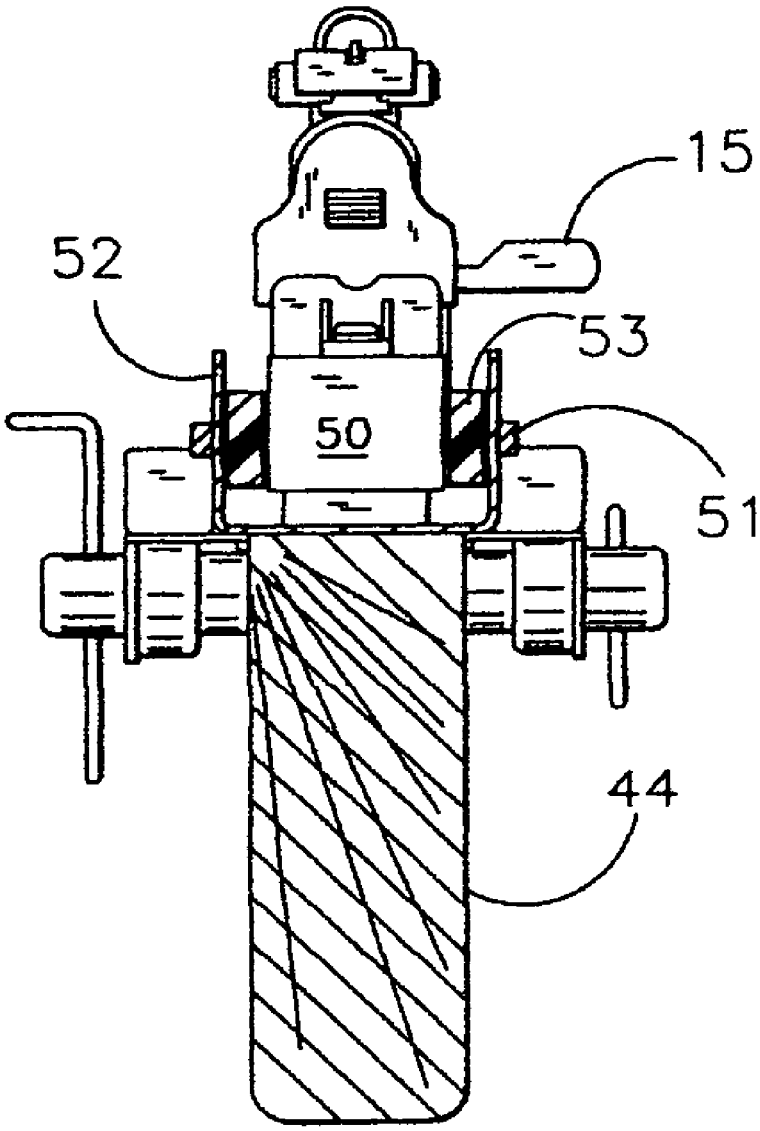
FIG. 9 is a cross-sectional view of the base of FIG. 5 taken along line 5-5 to show the pistol grip, slide mount, and slide of an embodiment of the base of the invention.

With reference to FIGS. 7 and 8, the phantom lines show the forward and rearward movement of the barrel 24, trigger 100 and receiver 22 (in phantom) upon base 40 during successive discharge of the firearm. In use, a shooter grasps grip 44 and depresses trigger 4 of trigger extension 42 to engage the trigger 100 and discharge the firearm, as represented in FIG. 7. The shooter holds trigger 4 of trigger extension 42 in the depressed position immobilizing trigger extension 42 in the position it has assumed to discharge the firearm. In response to the firearm's discharge, the receiver 22, the barrel 24, and the trigger assembly 26 move to the rearward position to effect complete disengagement of bolt 46 with trigger 100, as shown in FIG. 8.

Compression spring 59 continuously biases receiver 22, barrel 24, and trigger assembly 26 into the forward position (See FIG. 7) into engagement with the immobilized trigger extension 42 so that bolt 46, again, re-depresses trigger 100 to effect successive discharges of firearm 20.

It should be understood that the length of elongated members 62,64, and thus base 40 can be configured to suit the length of the particular firearm. Along these same lines, adjustments can also be made to the length of channel 56, slide mount 52, and slide 50 (See FIGS. 4 and 10-11), as desired. The free length, and thus tension of compression spring 59 can also easily be adjusted to accommodate different recoil forces corresponding to various different types of semi-automatic firearms. With the barrel 24 clamped inside barrel clamp 60, set collar screw 66 is loosened to permit an increase (less tension) or decrease (more tension) of the free length of compression spring 59. As a result, the distance between barrel clamp 60 and block 58 may be adjusted making base capable of use with most any semi-automatic firearm without substantially and irrevocably modifying the firearm.

The embodiment of base 40 of FIG. 4 employs a single compression spring 59, while the alternate embodiment of base 40 (FIG. 10) uses a pair of compression springs 59. Compression spring 59 of the embodiment of FIG. 4 is formed from wire having a size range of between about 0.05 and 0.10 inches, a free length range of between about 0.5 and 1.5 inches, and consists of between about 4 and 6 coils. More preferably, compression spring 59 of the embodiment of base 40 shown in FIG. 5 in combination with the AK-47 is formed from wire having a size of 0.080 inches, a free length of about one inch, and consists of five coils.

In a preferred embodiment, legs 70 are mounted to base 40 in tripod fashion, and the forward leg has a ring 73 so that base 40 can be secured to the ground surface. This prevents the front end of the device 110 from raising upward during discharge of the firearm. Base 40 may be secured to other surfaces by employing any one of a vast number of known means. Once base 40 is secured to a surface, the firearm can be operated essentially single-handedly. In any event, no "tricky" hand manipulations are necessary to operate device 110, and the inventor has found the shooter's shot to be more accurate as a result.

The alternate embodiment of base 40 (See FIGS. 10-11) is designed to support the A4 type semi-automatic firearms. Such firearms may include the reconfigured Browning M1919 A4, the 1917, the M-37, the MG-34, the M-2, and the Semi M-60. It is important to understand that some of these firearms, such as the Browning M1919 A4 for example, are vintage automatic firearms. Additionally, the invention does not contemplate use of such automatic firearms. Instead, the invention contemplates only use of these firearms that have been redesigned and designated as semi-automatic firearms and expressly approved by the Bureau of Alcohol, Tobacco and Firearms (BATF). The Browning M1919 A4 is such a firearm and is used in this disclosure as an example only; it is referred to throughout this description as the A4.

With respect to the assembly of the alternate combination base 40 and A4 type firearm, the A4 does not have to be disassembled. Referring to FIGS. 10-13, the A4 130 includes barrel 24, receiver 22, and a trigger assembly 26 having a trigger 100. Base 40 shown in FIGS. 10-11 has a pair of side-by-side compression springs 59. Each spring 59 is interposed on a cylinder beneath member 62, 64 between bolt mount 58' and trigger mount 129. In that embodiment, each spring 59 is generally formed from wire having a size range of between about 0.03 and 0.080 inches, a free length range of between about 3.0 and 4.0 inches, and consists of between about 20 and 30 coils. More preferably, compression spring 59 of the embodiment of base 40 shown in FIGS. 10-11 for use in combination with the A-4 is formed from wire having a size of 0.060 inches, a free length of about three and one-half (3.5) inches, and consists of twenty-four coils.

The A4 130 includes a buffer 138 with a grip 131. The front end of the receiver has a mounting bore 133 on each side and rings 132 integrally formed with receiver 22. Before securing the A4 to base 40, only buffer 138 is removed. Buffer 138 is replaced by buffer 150 (FIG. 13), which has no grip, and is attached to the A4 with bolts 135.

To secure the A4 to base 40, axel 51 and bolt 112 are slidably disengaged and removed from base 40. The A4 is positioned above base 40 so that trigger 100 of trigger assembly 26 is contacting trigger 4' in a manner like that described before in connection with the previous embodiment of FIG. 7. Rings 132 align with and receive bolt 112 and mounting bores 133 align with and receive axle 51 and thus, A4 is secured to base 40, which may include a tripod or other surface-engaging mounting scheme, as previously described.

The A4's barrel 24, trigger 100 and receiver 22, therefore, are capable of moving as a single unit upon base 40. Slide mount 52 permits movement of axle 51 in channel 56, in a manner like the above-described embodiment, between a forward and a rearward position during successive discharge of the firearm. In use, a shooter grasps spade grip 125 with both hands and depresses trigger 4 of trigger extension 42 with his thumbs. Trigger extension 42 pivots at pivot 128 to engage upstanding portion 101, which causes trigger 4' to engage trigger 100 and discharge the firearm. The shooter holds trigger 4 of trigger extension 42 in the depressed position immobilizing trigger 4' of trigger extension 42 in the position it has assumed to discharge the firearm. In response to the firearm's discharge, the receiver 22, the barrel 24, and the trigger assembly 26 move to the rearward position to effect complete disengagement of trigger 4' with trigger 100, in a manner like that shown and described above with respect to the embodiment of FIG. 8.

Compression spring 59 continuously biases receiver 22, barrel 24, and trigger assembly 26 of the A4 toward the forward position into engagement with the immobilized trigger extension 42 so that trigger 4', again, re-depresses trigger 100 to effect successive discharges of firearm 130.

While the invention has been illustrated and described in detail in the drawings and foregoing description, the same is to be considered illustrative and not restrictive in character. It is understood that the embodiments have been shown and described in the foregoing specification in satisfaction of the best mode and enablement requirements. It is understood that one of ordinary skill in the art could readily make a nearly infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A device for increasing the rate of the firing cycle of a semi-automatic firearm having at least a receiver, a barrel, and a trigger assembly, the device comprising:

a base for supporting the firearm;

a trigger extension with a grip attached to the base;

means for removably securing at least the receiver, the barrel, and the trigger assembly to the base, wherein the receiver, the barrel, and the trigger assembly are permitted to move as a single unit relative to the base between a rearward position upon discharge of the firearm and a forward position;

biasing means for continuously biasing at least the receiver, barrel, and trigger assembly toward the forward position; and a slide mounted on the base to permit movement of the at least receiver, barrel, and trigger assembly relative to the base.

2. The device of claim 1 wherein a pair of elongated members connect a slide mount at one end of the base, and a block at the other end.

3. The device of claim 2 further comprising a barrel clamp fastened to the base for removably securing the barrel to the base.

4. The device of claim 3 wherein the biasing means for continuously biasing the firearm toward the forward position comprises a coil spring operatively interposed between said barrel clamp and said block.

5. The device of claim 2 wherein said grip is a spade grip.

6. The device of claim 1 further comprising legs that telescopically engage the base.

7. A device for increasing the rate of the firing cycle of a semi-automatic firearm in combination with a semi-automatic firearm, said combination comprising:

a receiver and a barrel;

a trigger assembly;

a base for supporting said receiver, said barrel and said trigger assembly, said base further comprising a trigger extension with a grip;

a slide connected to the base effective for connecting the receiver, the barrel and the trigger assembly to the base, and for permitting the receiver, the barrel and the trigger assembly to move as a single unit relative to the base between a rearward position upon discharge of the firearm and a forward position; and, biasing means for continuously biasing the receiver, the barrel and the trigger assembly toward said forward position.

8. The combination of claim 7 wherein said means to removably secure the receiver, the barrel and the trigger assembly to the base to permit the receiver, the barrel and the trigger assembly to move as a single unit relative to the base includes a slide housed within a slide mount attached to the base.

9. The combination of claim 7 wherein a pair of elongated members connect the trigger extension and grip at one end of the base, and a block at the other end.

10. The combination of claim 9 further comprising a barrel clamp fastened to the base for removably securing the barrel to the base.

11. The combination of claim 10 wherein the biasing means for continuously biasing the receiver, the barrel, and the trigger assembly toward the forward position comprises a coil spring operatively interposed between said barrel clamp and said block.

12. The combination of claim 7 further comprising a barrel clamp fastened to the base for removably securing the barrel to the base.

13. The combination of claim 8 wherein said grip is a spade grip.

14. The combination of claim 7 further comprising legs that telescopically engage the base.

15. A method for increasing the rate of the firing cycle of a semi-automatic firearm having at least a receiver, a barrel, and a trigger assembly, the method comprising the steps of:

securing at least the receiver, barrel, and trigger assembly of the firearm to a base, said base including slide means effective for permitting the receiver, the barrel, and the trigger assembly to move as a single unit relative to the base between a rearward position upon discharge of the firearm and a forward position;

depressing the trigger with a trigger extension attached to the base to discharge the firearm;

immobilizing the trigger extension in the position it has assumed to discharge the firearm;

permitting the receiver, the barrel, and the trigger assembly to move to the rearward position in response to the firearm's discharge for effecting complete disengagement between the trigger extension and the trigger; and, sequentially biasing the receiver, the barrel, and the trigger assembly into engagement with the immobilized trigger extension for effecting successive discharges of the firearm.

* * * * *